US011268345B2

(12) United States Patent
Segura

(10) Patent No.: US 11,268,345 B2
(45) Date of Patent: Mar. 8, 2022

(54) SYSTEM AND METHOD FOR ELECTROMECHANICAL ACTUATOR APPARATUS HAVING A SCREEN ASSEMBLY

(71) Applicant: Bench Tree Group, LLC, Georgetown, TX (US)

(72) Inventor: Pedro R. Segura, Round Rock, TX (US)

(73) Assignee: Bench Tree Group, LLC, Georgetown, TX (US)

( * ) Notice: Subject to any disclaimer, the term of this patent is extended or adjusted under 35 U.S.C. 154(b) by 84 days.

(21) Appl. No.: 16/371,770

(22) Filed: Apr. 1, 2019

(65) Prior Publication Data

US 2019/0301267 A1 Oct. 3, 2019

Related U.S. Application Data

(60) Provisional application No. 62/650,805, filed on Mar. 30, 2018.

(51) Int. Cl.
*E21B 34/06* (2006.01)
*E21B 21/00* (2006.01)
*E21B 43/08* (2006.01)

(52) U.S. Cl.
CPC ..... *E21B 34/066* (2013.01); *E21B 21/002* (2013.01); *E21B 43/086* (2013.01); *Y10T 137/87507* (2015.04)

(58) Field of Classification Search
CPC ..... E21B 34/066; E21B 34/06; E21B 34/14; E21B 34/00; E21B 21/002; E21B 43/086; E21B 21/00; Y10T 137/87507
See application file for complete search history.

(56) References Cited

U.S. PATENT DOCUMENTS 4,499,951 A * 2/1985 Vann ..... E21B 33/12 166/296
6,044,808 A * 4/2000 Hollis ..... F01P 7/167 123/41.1
6,644,412 B2 * 11/2003 Bode ..... E21B 23/006 166/233
6,991,040 B2 * 1/2006 Hill, Jr. ..... E21B 43/103 166/373
7,861,787 B2 * 1/2011 Russell ..... E21B 43/25 166/310
9,091,143 B2 7/2015 Segura
10,174,580 B2 * 1/2019 Rowe ..... E21B 34/14
10,196,881 B2 * 2/2019 Kumar ..... E21B 43/08
10,641,053 B2 * 5/2020 Hrupp ..... E21B 43/086
(Continued)

*Primary Examiner* — Jessica Cahill
(74) *Attorney, Agent, or Firm* — Dunlap Codding, P.C.

(57) ABSTRACT

An electromechanical actuator having a servo valve is described. The servo valve has a valve housing having a wall surrounding the servo valve, the valve housing having a first end and a second end with the servo valve positioned between the first end and the second end. The valve housing also includes at least one debris vent positioned on an exterior surface of the wall between the servo valve and the first end of the valve housing, the debris vent having a first dimension; and, at least one fluid vent positioned on the exterior surface of the wall between the servo valve and the second end of the valve housing, the fluid vent having a second dimension. The first dimension is smaller than the second dimension.

12 Claims, 9 Drawing Sheets

(56) References Cited

U.S. PATENT DOCUMENTS

| | | | | |
|---|---|---|---|---|
| 2002/0038707 | A1* | 4/2002 | Gillespie | E21B 43/086 166/230 |
| 2007/0227733 | A1* | 10/2007 | Vercaemer | E21B 43/086 166/292 |
| 2017/0260831 | A1* | 9/2017 | Green | E21B 47/18 |

* cited by examiner

SYSTEM AND METHOD FOR ELECTROMECHANICAL ACTUATOR APPARATUS HAVING A SCREEN ASSEMBLY

INCORPORATION BY REFERENCE

The present patent application claims priority to the provisional patent application identified by U.S. Ser. No. 62/650,805, filed on Mar. 30, 2018. The entire content of U.S. Ser. No. 62/650,805 is hereby incorporated herein by reference.

BACKGROUND

Electromechanical actuator systems generally are well known and have existed for a number of years. In the downhole industry (oil, gas, mining, water, exploration, construction, etc), an electromechanical actuator may be used as part of tools or systems that include but are not limited to, reamers, adjustable gauge stabilizers, vertical steerable tools, rotary steerable tools, by-pass valves, packers, down hole valves, whipstocks, latch or release mechanisms, anchor mechanisms, or measurement while drilling (MWD) pulsers. For example, in an MWD pulser, the actuator may be used for actuating a pilot/servo valve mechanism for operating a larger mud hydraulically actuated valve. Such a valve may be used as part of a system that is used to communicate data from the bottom of a drilling hole near the drill bit (known as down hole) back to the surface. The down hole portion of these communication systems are known as mud pulsers because the systems create programmatic pressure pulses in mud or fluid column that can be used to communicate digital data from the down hole to the surface. Mud pulsers generally are well known and there are many different implementations of mud pulsers as well as the mechanism that may be used to generate the mud pulses.

Many existing systems do not have a separate screen housing from the oil compensated, sealed section. Additionally, many existing system do not have a "debris trap" to reduce the chance of clogging of a downhole vale. Thus, it is desirable to have an electromechanical actuator system with a screen housing that overcomes the limitations of the above typical systems and it is to this end that the disclosure is directed.

DETAILED DESCRIPTION OF ONE OR MORE EMBODIMENTS

Figure 1:
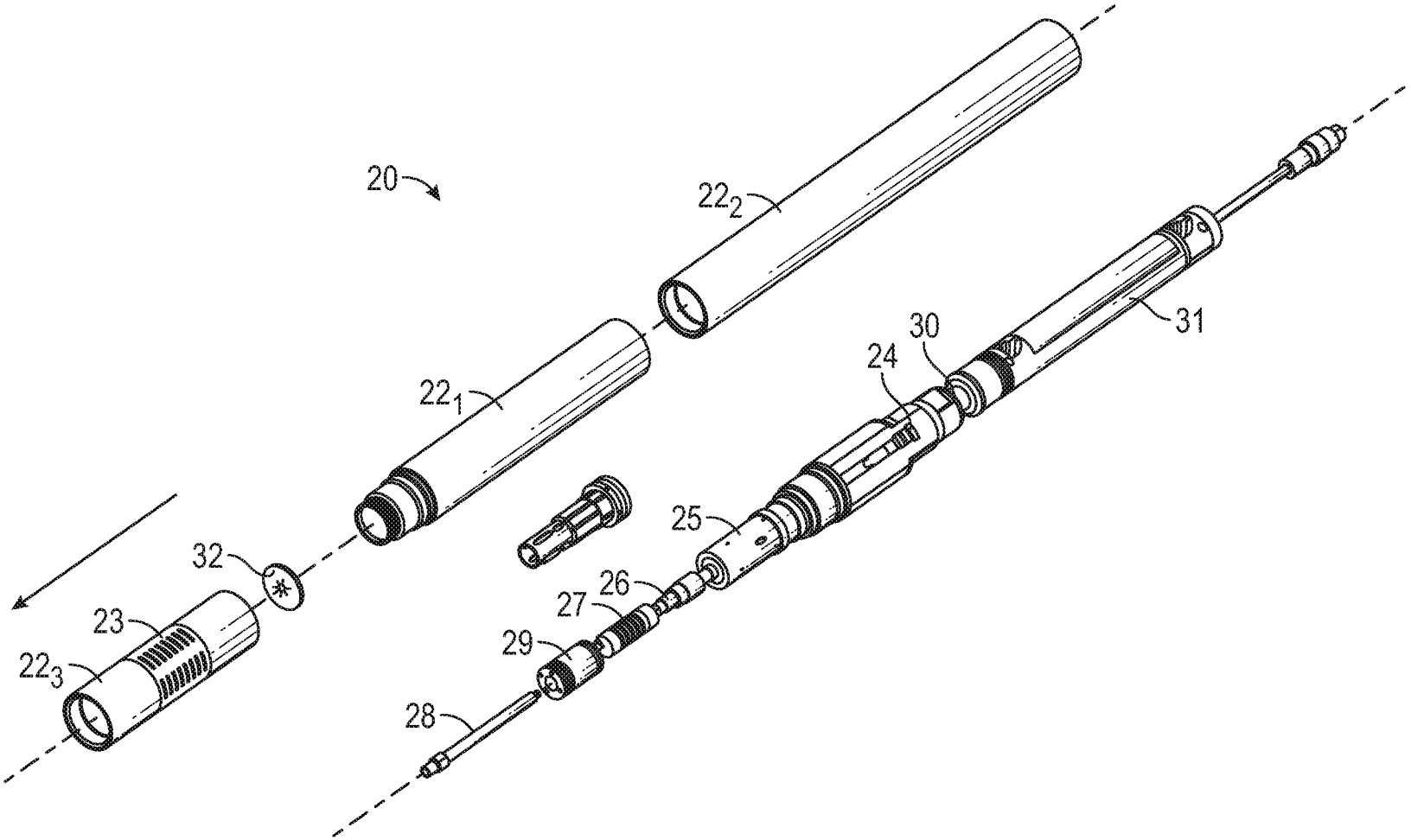
FIG. 1 is an illustration of a preferred embodiment of an electromechanical actuator.

The following detailed description refers to the accompanying drawings. The same reference numbers in different drawings may identify the same or similar elements.

The mechanisms proposed in this disclosure circumvent issues described above. The apparatus and method are applicable to the actuation of down-hole tools, such as in borehole drilling, workover, and production, and it is in this context that the apparatus and method will be described. The down-hole tools that may utilize, be actuated and controlled using the apparatus and method may include but are not limited to a reamer, an adjustable gauge stabilizer, vertical steerable tool, rotary steerable tool, by-pass valve, packer, control valve, latch or release mechanism, and/or anchor mechanism. For example, in one application, the actuator may be used for actuating a pilot/servo valve mechanism for operating a larger mud hydraulically actuated valve such as in an MWD pulser.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the inventive concept. This description should be read to include one or more and the singular also includes the plural unless it is obvious that it is meant otherwise.

Further, use of the term "plurality" is meant to convey "more than one" unless expressly stated to the contrary.

Also, certain portions of the implementations have been described as "components" or "circuitry" that perform one or more functions. The term "component" or "circuitry" may include hardware, such as a processor, an application specific integrated circuit (ASIC), or a field programmable gate array (FPGA), or a combination of hardware and software. Software includes one or more computer executable instructions that when executed by one or more component cause the component or circuitry to perform a specified function. It should be understood that the algorithms described herein are stored on one or more non-transient memory. Exemplary non-transient memory includes random access memory, read only memory, flash memory or the like. Such non-transient memory can be electrically based or optically based. Further, the messages described herein may be generated by the components and result in various physical transformations.

Finally, as used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

Figure 2:
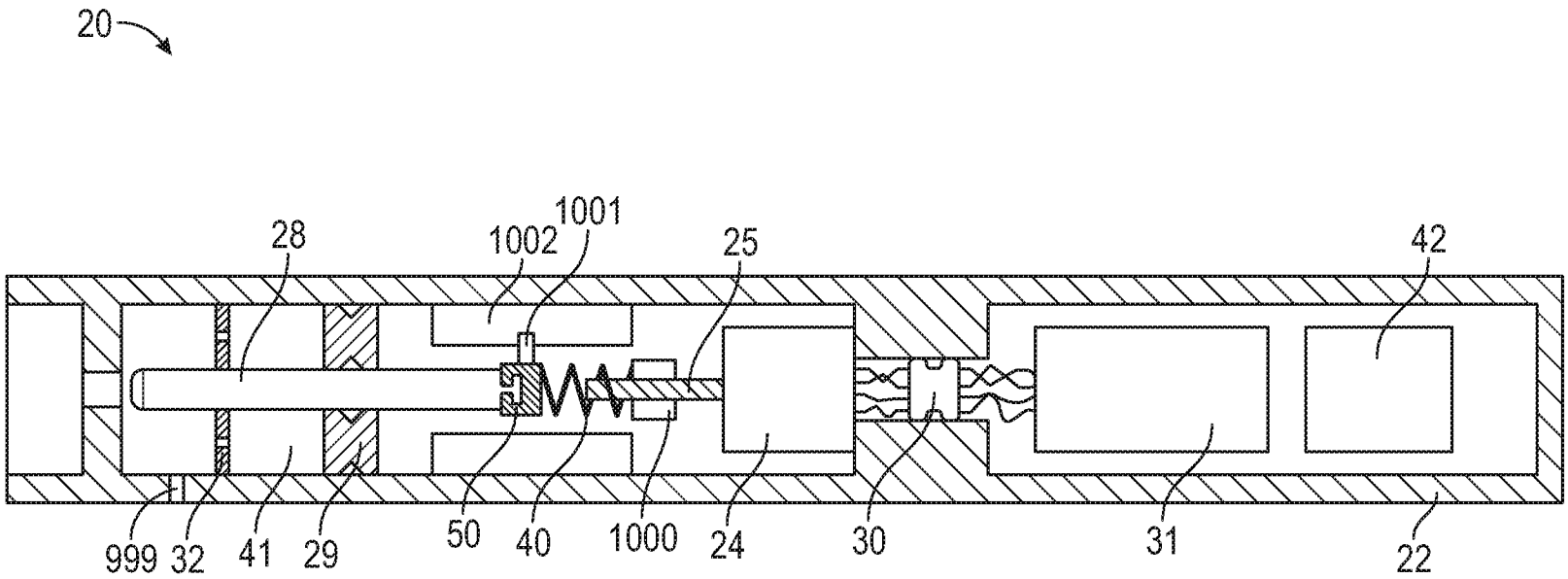
FIG. 2 illustrates an embodiment of the electromechanical actuator of FIG. 1.

FIG. 1 is an illustration of an electromechanical actuator assembly 20 that may be used, for example, in a down-hole MWD pulser tool. The actuator may comprise a first and second housing $\mathbf{22}_1$, $\mathbf{22}_2$ that house a number of components of the actuator and a valve housing $\mathbf{22}_3$ that connects to the housing $\mathbf{22}_1$ The actuator assembly 20 may further comprise a rotary actuator 24, and a lead or ball screw 26 that actuate the servo shaft of down hole tool. The actuator assembly 20 may also have one or more shock absorbing and self-aligning members 27 that absorb shocks from the rotary actuator 24 and may compensate for misalignments. The shock absorbing and self-aligning member 27 may also absorb shock applied to the shaft or piston by external forces. In one implementation (for a particular set of load and temperature requirements), the shock absorbing and self-aligning member 27 (as shown in FIG. 2) may be a machined helical spring 40 that is made of metal integral to the coupling between the reciprocating nut of the ball screw 26 and the shaft 28. However, the shock absorbing member and self-aligning members 27 may take other forms and may also be made of different materials as would be chosen by someone of ordinary skill in the art and depending on the load and temperature requirements for a particular application.

The actuator assembly 20 may also have a shaft 28 that connects to the downhole tool through a pressure compensation system 29 and, optionally one or more buffer discs 32, such as one buffer disc or a stack of buffer discs, whose function is described below in more detail. The buffer disc 32 (see also FIG. 2) may be made of a high temperature thermoplastic, but may also be made of other materials depending on the load and temperature requirements for a particular application.

The actuator assembly 20 may also have a fluid slurry exclusion and pressure compensating system 29 that balances pressure within the actuator with borehole pressure. The actuator may also have a pressure sealing electrical feed thru 30 that allows the actuator to be electrically connected to electronic control components, but isolates the electronic control components from fluid and pressure. In particular, when downhole, the pressure within the oil filled, pressure compensated system is essentially equal to the pressure in the borehole and this pressure is primarily the result of the fluid column in the borehole. The details of the fluid slurry exclusion and pressure compensating system 29 are described below in more detail. The pressure sealing electrical feed thru 30 may have a metal body with sealing features, metal conductors for electrical feed thru, and an electrically insulating and pressure sealing component (usually glass or ceramic) between the body and each of the conductors. Alternatively, the pressure sealing electrical feed thru 30 may be a plastic body with sealing features and metal conductors for electrical feed thru.

The actuator assembly 20 may also have a set of electronic control components 31 that control the overall operation of the actuator assembly 20 as described below in more detail. The set of electronic control components 31 are powered by an energy source (not shown) that may be, for example, be one or more batteries or another source of electrical power. Now, further details of an example of an implementation of the electromechanical actuator are described in more detail with reference to FIG. 2.

FIG. 2 illustrates an illustration of an embodiment of the electromechanical actuator assembly 20 of FIG. 1. Typical actuator systems may utilize an elastomeric bellows/membrane system for pressure compensation whereas, as shown in FIG. 2, the subject actuator assembly 20 may include a piston that is part of the fluid slurry exclusion and pressure compensating system 29. The pressure compensation system 29 is a dielectric fluid filled chamber with features for excluding the abrasive, conductive, corrosive, mud slurry used in drilling and construction from the close tolerance and/or non-corrosion resistant, and/or electrical/electronic components of the actuator assembly 20 while balancing pressure differential across borehole fluid to tool interface seals to minimize actuator load requirements and hence power requirements. In one implementation, the actuator assembly has a compact configuration with a piston over the shaft 28 (in both reciprocating and rotating versions). The piston is located in a position within the assembly as to minimize the system's overall length, improve access to seals and internal mechanism, reduce part count, and enable pressure communication.

The actuator configuration reduces costs by reducing the number of components and material needed for manufacture, simplifying machining, lowering weight and hence reducing logistical costs, and simplifying maintenance by providing improved access to components that require frequent replacement. The location of the piston also eliminates the need for secondary set of fluid pressure vents 999 or ports in the housings as may be needed with typical compensation systems. The location of the piston thus reduces housing outer diameter wear due to fluid slurry erosion by making the outer housing diameter more uniform by excluding the vents, since erosive wear is usually concentrated directly downstream of surface discontinuities.

The actuator implementation shown in FIG. 2 may have a lubrication device 41, such as for example a grease pack, on an end to buffer the compensation system seals on the outer diameter (OD) and inner diameter (ID) of the pressure compensating system 29 from abrasive fluid slurry. The lubrication device 41 lubricates and/or occupies voids that would be filled by air or borehole fluids in the housing while conforming to the shapes of the volumes in the housing that it occupies even if they are variable. The buffer disc 32 aids in retaining grease and excluding larger debris, and also provides additional lateral support for the shaft 28 extending through it. In one implementation, the buffer disc 32 is vented to allow pressure communication between the grease packed volume and the wellbore fluid. In addition or alternatively, the housings adjacent to the buffer disc may also be vented to allow this communication. In one implementation, the buffer disc 32 is captured between two of the housings that thread together (as shown in FIG. 1) so that no other method of fastening or centering it may be required. The buffer disc 32 may also be split or slotted to allow assembly/disassembly if a component or feature of diameter larger than the shaft is obstructing the end of the shaft and/or positioned in such a way that the disc cannot be installed by inserting over the shaft end. The buffer disc 32 may be axially compliant and laterally stiff which is accomplished, in one embodiment, by including multiple radial slits from the inner diameter to a distance less than the outer diameter. The axial compliance of the buffer disc 32 is a release mechanism in the event that debris becomes trapped or wedged between the reciprocating shaft and the buffer disc inner diameter and is also a pressure relief mechanism in the event that pressure fluid vents become clogged. In other embodiments, the buffer disc 32 may be a flexible, compliant member that would not require venting. For example, the buffer disc 32 could be a rubber membrane that would stretch with volume changes without significantly adding a load to the actuator in the instances described above and would also flex in reciprocation or rotation if attached to the shaft, piston, or housings. The buffer disc 32 could also be a combination of rigid and elastomeric materials to achieve lateral support and axial compliance.

The shaft 28 that extends from the oil filled section, through the pressure compensation system 29 inner diameter seal, through the lubrication device 41, buffer disc 32 and into the wellbore fluid, may be of uniform diameter to prevent any interference of reciprocating motion by components or debris that may find its way to the area.

In an alternative embodiment, the piston compensation and exclusion system may be converted to an elastomeric membrane compensation system easily by removing the pressure compensation system 29 (i.e., piston) and mounting the elastomeric membrane assembly into the same seal area. This embodiment of the actuator may be used for systems requiring the elimination of seal friction, as required for pressure measurement, precise control, or lower force actuators.

In the actuator assembly 20, the rotary actuator 24, such as, but not limited to, an electric motor, rotary solenoid, hydraulic motor, piezo motor and the like, for example, is installed with a ball or lead screw 25 integral to or attached to an output shaft of the rotary actuator 24. The screw 25 rotates, the nut 1000 moves linearly, reciprocates, and the nut is then coupled to the actuated/reciprocating member(s)/component(s) 40, 50, 1001, 28. Alternatively, the motor shaft can incorporate features of the ball or lead screw nut or be attached to the ball or lead screw nut so that the nut rotates, the screw moves axially and the screw 25 is integral to or coupled to the actuated/reciprocating member(s)/component(s) 40, 50, 1001. In the embodiment shown in FIG. 2, the nut and attached or integral reciprocating members reciprocate with shaft-screw rotation, but the rotation of the reciprocating, axially moving, member(s) is prevented by an anti-rotation feature or member, 1001. This feature or component may be, for example, a pin, key, screw-head, ball, or integrally machined feature that slides along an elongated stop or slot 1002 in the surrounding actuator guide or a surrounding housing. Alternatively, the anti-rotation member can be attached to or be integral to the guide/housing or other adjacent structure, and will prevent rotation of the reciprocating member by sliding along a slot/groove or elongated stop in a reciprocating member(s). Alternatively, the anti-rotation member can be captured within elongated stops or slots or keys in both the reciprocating and the stationary member(s). The guide and/or surrounding housing and/or reciprocating members and/or rotating members are vented to allow fluid transfer between various cavities that change volume as the actuator reciprocates. In one embodiment as shown in FIG. 1, the guide is attached to the rotary actuator guide housing.

In one embodiment, the thrust created by loading the reciprocating member or applied to reciprocating member is countered by a member which is a combined thrust/radial bearing within the rotary actuator). This member, a bearing, can accommodate the axial and also radial loads while minimizing torque requirements of the rotary actuator. This type of bearing is well known. However, typically and in the existing downhole actuators, a thrust bearing(s) external to the rotary actuator are implemented, while the rotary actuator contains only the radial support bearings. Combining the radial and thrust bearing into the actuator, as in the described device, reduces the number of components and reduces the assembly's overall length, improving reliability, and simplifying assembly/disassembly. However, the thrust bearing can alternately or additionally be attached to or integrated within the rotary actuator shaft or ball/lead screw non-reciprocating components as is typically done also.

Typical downhole actuator systems require an oversized lead or ball screw, thrust bearings, and reciprocating components to tolerate larger loads that may be caused by impacting at the reciprocating member. This can be the case when seating a rigid valve, for example. In the actuator shown in FIGS. 1 and 2, the system components are significantly smaller due to the addition of an integral or attached shock absorbing member or members 27 in FIG. 1 (and 40 in FIG. 2) such as mechanical springs. The shock absorbing member or members reduces the peak shock loads and accommodates misalignments, thereby reducing other loads and the strength requirements of the other actuator components. The shock absorbing member or members 27/40 may be placed inline or within the rotary actuator shaft, reciprocating members, or between nut and seat, or on thrust bearing(s), or in the actuated devices (external to the actuator). In one embodiment, it is integrated to a coupling which is attached to the reciprocating member of the ball or lead screw 26 as shown in FIG. 2. The integration of the shock absorbing member reduces loads, which enables a reduction in component strength requirements, which enables a reduction in component size, and hence reduces overall component mass, which in turn enables a reduction in the system size and power requirements. This is important, for example, in battery operated systems such as downhole devices that may use the actuator. The smaller components also enable smaller diameter assemblies which is often required in drilling, for example, in systems requiring high fluid flow capability or assemblies to be used in smaller diameter assemblies used in drilling or servicing smaller holes. This is also important when mounting assemblies in the walls of collars or pipe as may be configured for some tools. The shock absorbing member and self-aligning members 27 may also provide compliance to accommodate assembly misalignments which is important to reduce wear and fatigue of the system components. This compliance may also reduce stresses, which also enables a reduction in components size, thus providing the benefits described above.

For a reciprocating system, the axial compliance of the shock absorbing member(s) 27/40 can also be adjusted to control the rates of load increase and decrease, which provides a control feedback mechanism for the electronics. If a mechanical spring(s), for example, the spring rate(s) can be increased, decreased, or stepped, to alter the detectable load rate. For a rotary system, torsional spring(s) rate(s) can be adjusted as needed to provide feedback/control also.

The shock absorbing member(s) 27/40 in another embodiment includes a mechanical spring(s), which upon loading, compresses or extends. This reduces or increases the size of gaps in the mechanical spring structure, which act as fluid vents or ports. As the vents close or open, the change in hydraulic flow area(s) cause additional changes in load, which can be detected by the electronics for control purposes. This porting can also be integrated to non shock-absorbing components, in which overlapping openings between reciprocating and non-reciprocating components act as the variable area vents or ports for a fluid. The non-restricted fluid passages/openings then vary in flow area as a function of position of the reciprocating components. Here also, the change in flow areas alters the loads which can be detected by the control electronics. In addition, the clearances between the between the reciprocating member and the static members in the actuator change the hydraulic flow/loads that may also be detected by the control electronics.

Figure 3A:
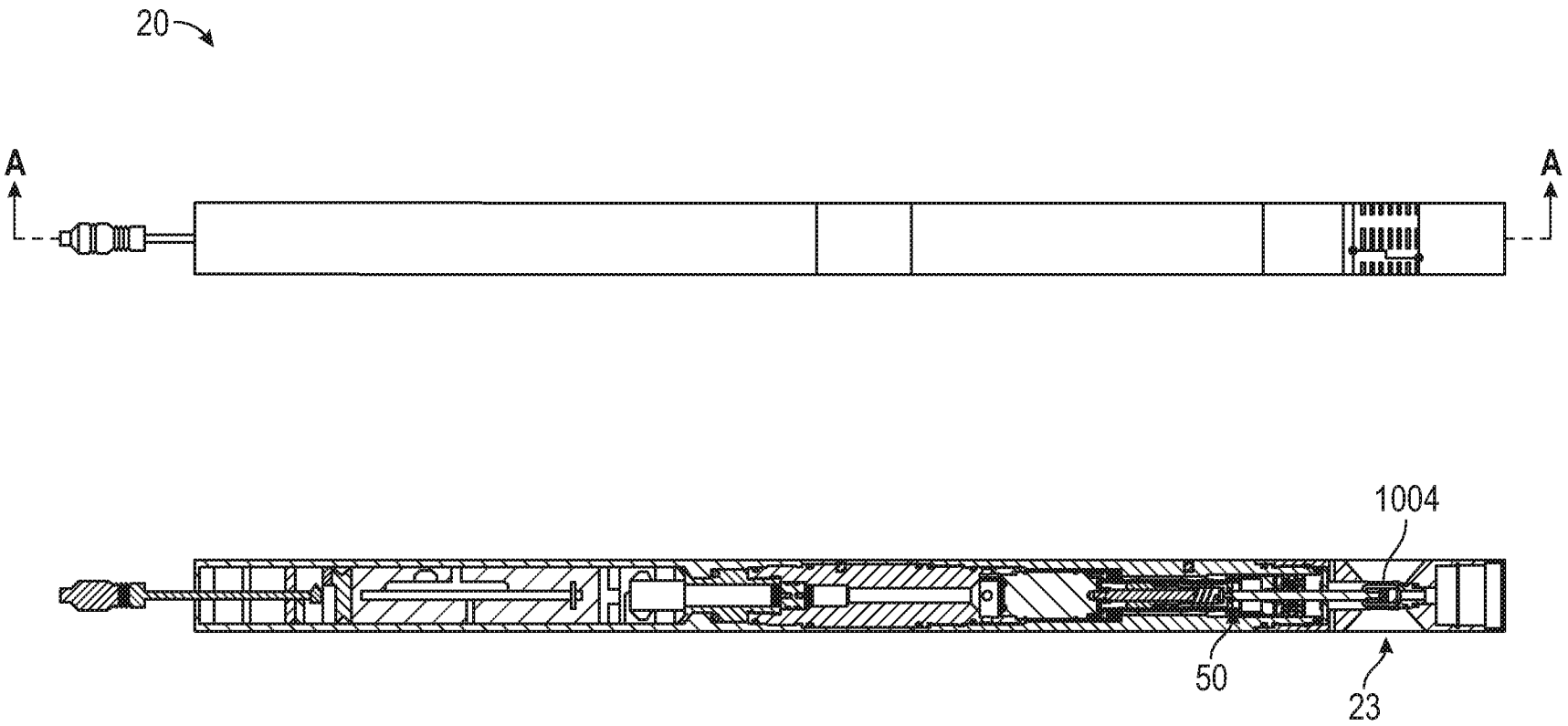
FIG. 3A is an assembly cross-section diagram of the embodiment of the electromechanical actuator of FIG. 2.

FIG. 3A is an assembly cross-section diagram of the embodiment of the electromechanical actuator of FIG. 2. In some embodiments, the shaft 28 of the actuator assembly 20 may be easily replaceable. As shown in FIGS. 2 and 3A, the actuator assembly 20 may have a shaft T-slotted coupling 50 that allows lateral motion for installation and removal of the shaft until a piston or other member that prevents lateral travel is installed. After the pressure compensating system 29 (e.g., piston) is installed, the shaft is captured, and lateral motion is prevented by the piston. The shaft 28 is dimensioned to minimize diameter and to minimize volume changes with reciprocation, while maintaining load capacity. The shaft is also dimensioned to allow the piston seal to slide over end attachment features without damaging said piston seal. The shaft is also sized as to minimize the mass, and hence inertia, of the actuated system to reduce power requirements of the motor. The shaft 28 may be attached to the shaft T-slotted coupling 50 in other ways as well. For example, the shaft can be integral to the coupling or screw, threaded to the coupling or screw, or be attached with a clip(s) or threaded fasteners. In the embodiment shown in FIG. 3A, the coupling allows easy removal and reinstallation while providing a more secure attachment. While threaded fasteners may loosen in high vibration environments, the shaft T-slotted coupling 50 will not loosen.

In some embodiments, the valve housing $\mathbf{22}_3$ may include a screen assembly 23. The valve housing $\mathbf{22}_3$ may hold one or more components of the actuator 10 that are not within the dielectric fluid (such as for example oil, filled housing $\mathbf{22}_1$). In some embodiments, the screen assembly 23 may be a replaceable screen assembly. For example, components of the actuator 10 that are not within the oil filled housing can thus be more easily accessed by removing the screen assembly 23 and/or one or more portions thereof so that those components are exposed for more easily assembly and disassembly, and maintenance can conveniently be performed on them. For purposes of illustration, an oil filled housing is described herein, but it should be understood that the actuator 10 may also be filled with another dielectric fluid.

As shown in FIG. 3A, the exemplary screen assembly 23 may be around one or more portion of an outer diameter of the valve housing $\mathbf{22}_3$. Cavities 1004 between the inner diameter of the screen assembly and housing slots act as debris trap(s) on the downhole side of a pilot valve orifice. The housing may trap the buffer disc as discussed above. The screen may be slotted or perforated and relieved for fluid passage. The screen assembly 23 provides a more uniform OD than previously used systems and the changeable screen is designed for easy replacement in case of erosion of a component. The screen assembly 23 also uses a minimal number of retainers/screws to reduce the chance of losing components down-hole.

The seal to the compensation system fluid may not be integral to the screen assembly 23 as in other systems. This may allow for removal of the screen assembly 23 for cleaning and/or replacement without breaching the compensation system seals. For example, the screen assembly 23 may be removed due to erosion or discontinuities of the outer diameter discontinuities. The screen assembly 23 may also be prone to clogging with debris. Removal of the screen assembly 23 may provide for field replacement and/or servicing of the screen assembly 23 or components housed within the valve housing $\mathbf{22}_3$. Additionally, the type of screen assembly 23 used within the field may be changed based on debris, LCM and/or fluid type. In some embodiments, the screen assembly 23 may be installed and/or changed on pre-assembled actuators 10 to re-purpose use.

In an alternative to the screen assembly 23 described above, the actuator 10 may be attached to and separated from the screen assembly 23.

Figure 3B:
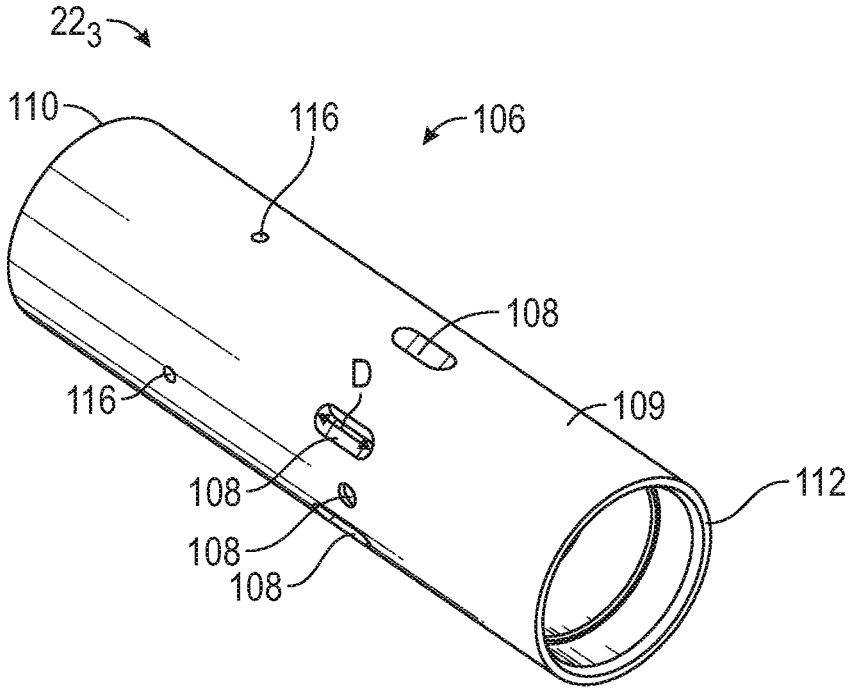
FIG. 3B is a perspective view of an exemplary screen less valve housing for use in the electromechanical actuator illustrated in FIG. 1.
Figure 3C:
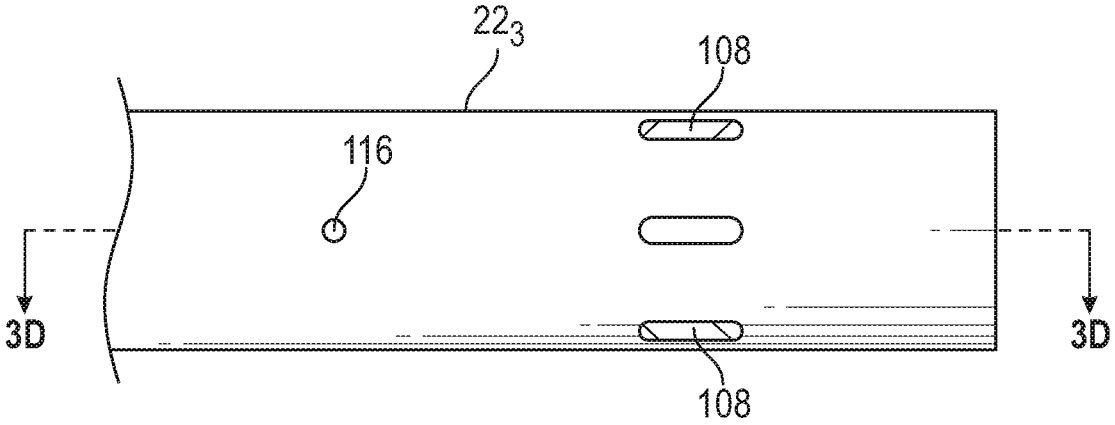
FIG. 3C is a side view of the screen less valve housing illustrated in FIG. 3B.
Figure 3D:
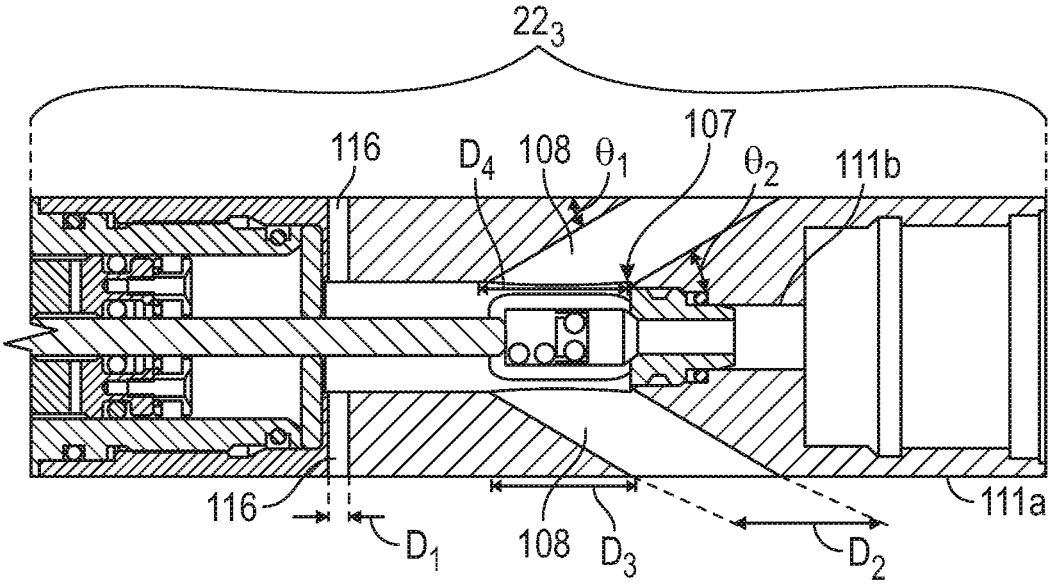
FIG. 3D is a cross sectional view of the screen less valve housing illustrated in FIG. 3C.

FIGS. 3B-3D illustrate an exemplary embodiment of a screen-less filtering system 106 for use with the valve housing $\mathbf{22}_3$ illustrated in FIG. 1. During operation of the actuator 10 in mud having debris or lost circulation material (LCM), a servo valve 107 positioned within the valve housing $\mathbf{22}_3$ may be subject to debris or LCM. The screen-less filtering system 106 includes a plurality of openings as described below that may be sized and positioned for material to exit from the valve housing $\mathbf{22}_3$ while shielding components in the valve housing $\mathbf{22}_3$ from a primary fluid path and/or other mechanical damage. Additionally, the screen-less filtering system 106 may enable flow of material from the valve housing $\mathbf{22}_3$ regardless of state of the servo valve 107 (i.e., open or closed).

The valve housing $\mathbf{22}_3$ may include one or more fluid vents 108, with multiple fluid vents 108 shown by way of example in FIG. 3B. Generally, the one or more fluid vents 108 may be positioned on a wall 109 of the valve housing $\mathbf{22}_3$ downstream of the servo valve 107 and extend inward through the wall 109 of the valve housing $\mathbf{22}_3$ toward the servo valve 107 as shown in FIG. 3C. In the example shown, the valve house $\mathbf{22}_3$ includes multiple fluid vents 108 spaced apart and positioned about the circumference of the wall 109. In the example shown, the valve housing $\mathbf{22}_3$ may have a first end 110 and a second end 112. The servo valve 107 may be positioned between the first end 110 and the second end 112 of the valve housing $\mathbf{22}_3$ with the first end 110 being upstream of the servo valve 107 and the second end 112 being downstream of the servo valve 107. The fluid vents 108 may be positioned on the wall 109 of the valve housing $\mathbf{22}_3$ between the servo valve 107 and the second end 112 of the valve housing $\mathbf{22}_3$ with the fluid vents 108 extending through the valve housing $\mathbf{22}_3$ and angled toward the servo valve 107.

Generally, positioning of the fluid vents 108 may be designed to reduce accumulation of debris and/or lost circulation material about the servo valve 107 and/or reduce mechanical damage to the servo valve 107. As described above, one or more fluid vents 108 may be formed at an acute angle in the wall 109 in the valve housing $\mathbf{22}_3$ generally toward the servo valve 107. For example, FIG. 3C illustrates the fluid vents 108 positioned at an acute angle $\Theta_1$ relative to an exterior surface 111*a* of the valve housing $\mathbf{22}_3$; and an acute angle $\Theta_2$ relative to an interior surface 111*b*. The interior surface 111*b* may be parallel to a longitudinal axis of the valve housing $\mathbf{22}_3$. In this embodiment, the acute angle $\Theta_2$ would also be relative to the longitudinal axis. Determination of the angles $\Theta_r$ and $\Theta_2$ may be based on flow of material through the valve housing $\mathbf{22}_3$. For example, in some embodiments, determination of the angles $\Theta_1$ and $\Theta_2$ may provide a streamlined flow profile, aid in material flow out of the valve housing $\mathbf{22}_3$, reduction of erosion, and/or the like. Additionally, in some embodiments, the angles $\Theta_1$ and $\Theta_2$ may be determined to provide for limited to no direct lateral access to a servo shaft 114 and/or the servo valve 107. The angles $\Theta_1$ and $\Theta_2$ may be less than 90 degrees. In one embodiment, the angles $\Theta_1$ and $\Theta_2$ are different so that the a cross sectional area of the fluid vents 108 increase from the interior surface 111*b* to the exterior surface 111*a* so as to provide the fluid vents 108 with a funnel-like shape.

The fluid vents 108 may be any shape capable of providing filtering of debris and LCM and/or aiding fluid flow as described herein. The fluid vents 108 in FIG. 3B are illustrated as oval, however, the fluid vents 108 may have any shape including, but not limited, square, polygonal, and/or any fanciful shape configured to provide filtering as described herein. Generally, the fluid vents 108 may have cross-sectional dimensions D2 and D4 with the dimension D2 being at the exterior surface 111*a*, and the dimension D4 being at the interior surface 111*b*. In one embodiment, the dimension D2 is larger than the dimension D4 so as to provide the funnel like shape. The fluid vents 108 can also be characterized by a dimension D3 extending generally from a first side 117 of the fluid vent 108 at the exterior surface 111*a* to the interior surface 111*b*. In one embodiment, the dimension D3 is greater than or equal to the dimension D4. The dimensions D2, D3, and D4 may be a maximum dimension of the fluid vents 108. The dimensions D2, D3, and D4 may be between 0.25-0.5 inches, for example. The fluid vents 108 may be of uniform size or have one or more varying sizes. Additionally, any number of fluid vents 108 may be provided. The fluid vents 108 may be equally spaced about the valve housing $\mathbf{22}_3$ or have a random pattern or fanciful pattern.

The screen-less filtering system 106 may also include one or more debris vents 116 formed in the sidewall 109. The debris vents 116 may be used to relieve pressure and/or enable flow of material from the valve housing $\mathbf{22}_3$. Generally, the debris vents 116 may be positioned upstream of the servo valve 107. The debris vents 116 may be positioned on the valve housing $\mathbf{22}_3$ between the servo valve 107 and the first end 110 of the valve housing $\mathbf{22}_3$.

The debris vents 116 may be any shape capable of relieving pressure and/or enable flow of material from the valve housing $\mathbf{22}_3$. The debris vents 116 in FIG. 3B are illustrated as circular, however, the debris vents 116 may be any shape, including, but not limited to, square, oval, and/or any fanciful shape. The debris vents 116 may have a cross-sectional dimension $D_1$. The dimension $D_1$ may be a maximum dimension of the debris vents 116, and may be smaller than the maximum dimension D of the fluid vents 108. For example, in some embodiments, the debris vents may be a circular shape, and the dimension $D_1$ may be 1/16 of an inch. Any number of debris vents 116 may be provided on the valve housing $\mathbf{22}_3$. The debris vents 116 may be of uniform size or have one or more varying sizes. Additionally, the debris vents 116 may be uniformly spaced or randomly spaced. In some embodiments, three or more debris vents 116 may uniformly spaced with additional debris vents 116 randomly spaced. The debris vents 116 may be angled, similar to the fluid vents 108 or perpendicular to the external surface 111*a* of the valve housing $\mathbf{22}_3$.

Figure 3E:
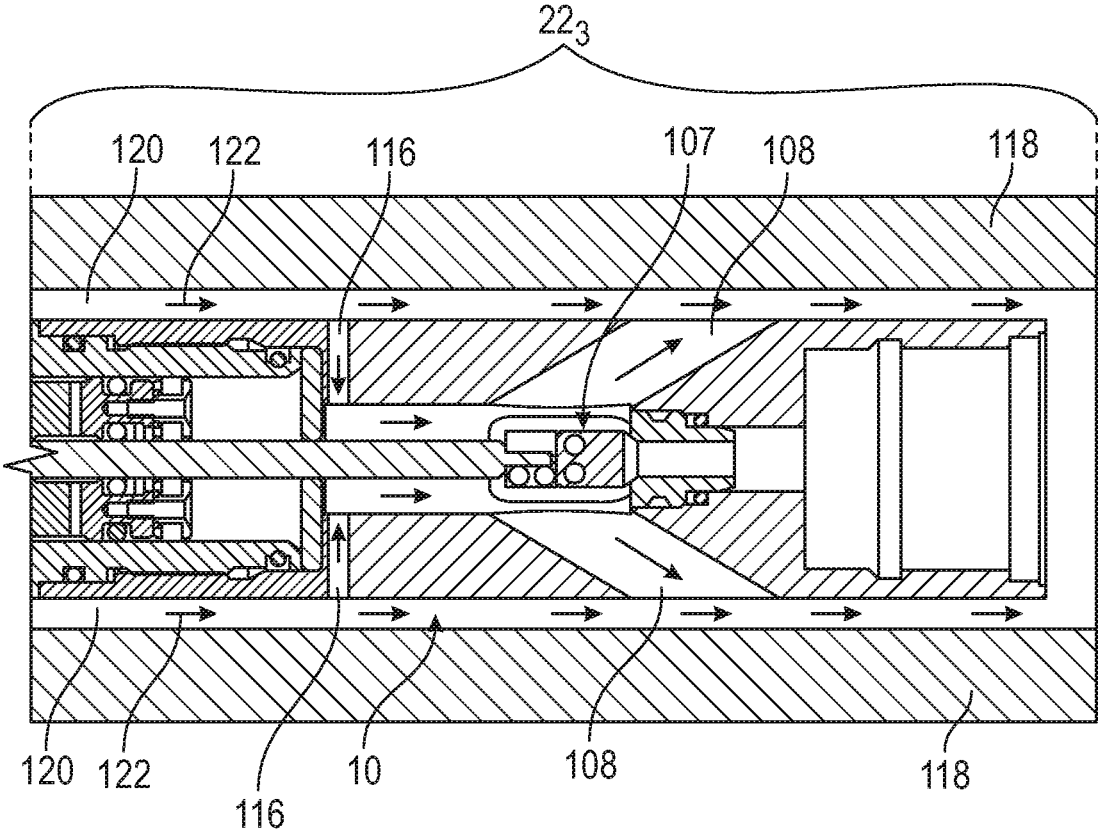
FIGS. 3E and 3F illustrate exemplary fluid flow paths through the exemplary screen less valve housing illustrated in FIG. 3B as the screen less valve housing is positioned within earth.
Figure 3F:
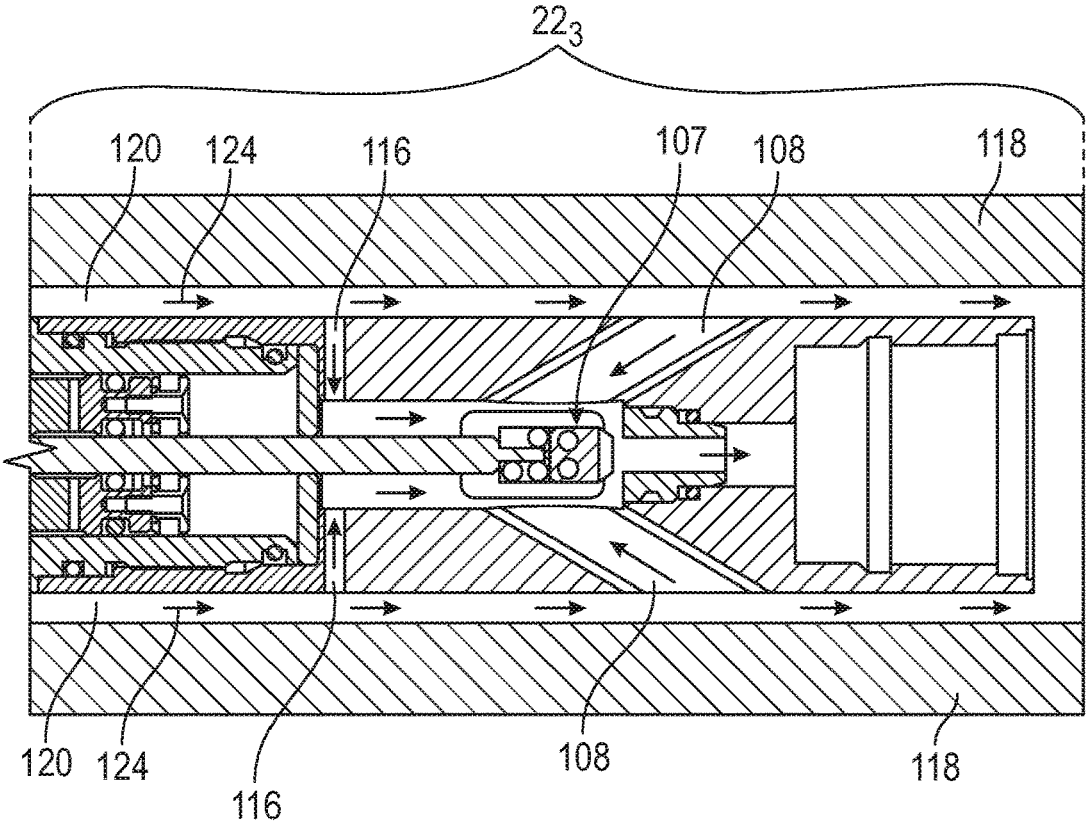

Referring to FIGS. 3E and 3F, during operation, the actuator 10 may be positioned within earth 118 such that an opening 120 exists between the actuator 10 and earth 118. Mud having high concentrations of debris or LCM may enter the actuator 10 and the opening 120 as indicated by fluid flow arrows 122. When the servo valve 107 is closed, as illustrated in FIG. 3E, mud pumps at the surface may provide for fluid to flow through the debris vents 116 and the vents 108 as shown by the fluid flow arrows 122. Debris vents 116 and fluid vents 108 may provide the fluid flow path limiting debris and/or LCM collection within the valve housing $\mathbf{22}_3$.

Referring to FIG. 3F, when the servo valve 107 is open, fluid may be routed into the valve housing $\mathbf{22}_3$ due to a pressure differential and as such debris and/or LCM may be sucked into the valve housing $\mathbf{22}_3$ from the fluid flow path as indicated by fluid flow arrows 124. Debris and/or LCM in the valve housing $\mathbf{22}_3$ may be limited as compared to other prior art system as the majority of fluid entering may be via the fluid vents 108 having a larger opening.

Figure 3G:
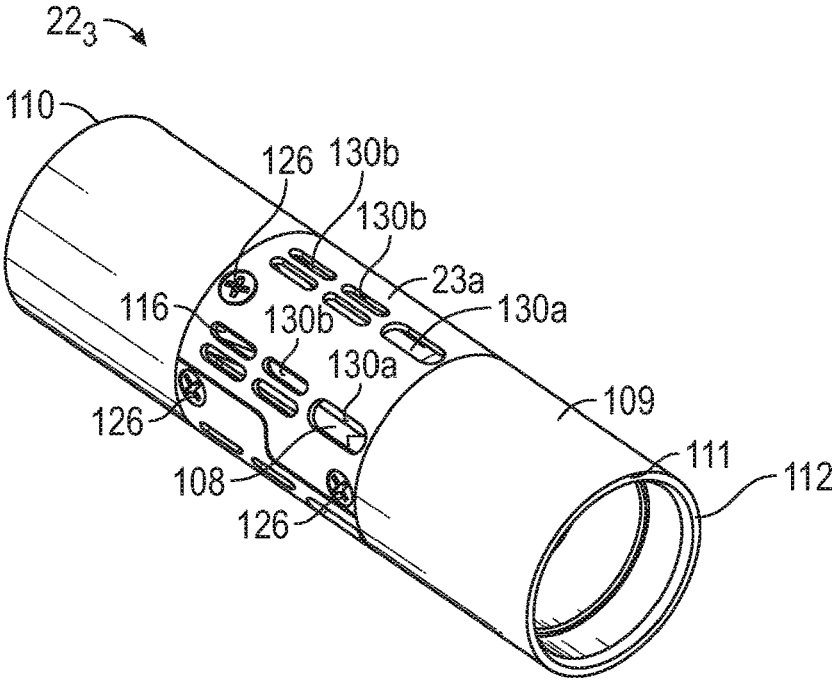
FIG. 3G illustrate another exemplary screen assembly for use in the valve housing of the electromechanical actuator illustrated in FIG. 1.

FIG. 3G illustrates another exemplary embodiment of a screen assembly 23*a* for use with the valve housing $\mathbf{22}_3$ illustrated in FIG. 1. The screen assembly 23*a* may be positioned about one or more portions of the wall 109 of the valve housing $\mathbf{22}_3$, and in particular the external surface 111*a* of the valve housing $\mathbf{22}_3$. For example, in FIG. 3G, the screen assembly 23*a* is positioned between the first end 110 and the second end 112 on the wall 109 of the valve housing $\mathbf{22}_3$. Generally, the screen assembly 23*a* may be positioned such that the screen assembly 23*a* extends across the servo valve 107 positioned within the valve housing $\mathbf{22}_3$. In some embodiments, the screen assembly 23*a* may circumferentially wrap about the entire and/or one or more portions of the external surface 111 of the valve housing $\mathbf{22}_3$. Additionally, attachment of the screen assembly 23*a* to the wall 109 of the valve housing $\mathbf{22}_3$ may be via adhesive, screws, and/or the like. For example, in FIG. 3G, attachment of the screen assembly 23*a* to the valve housing $\mathbf{22}_3$ is via a plurality of screws 126.

The screen assembly 23*a* may be positioned over one or more fluid vents 108 and/or one or more debris vents 116. In some embodiments, the screen assembly 23*a* may include a plurality of slots 130 allowing for flow of fluid to the one or more fluid vents 108 and/or debris vents 116. The slots 130 may have uniform sizing or different sizing. In some embodiments, a plurality of slots 130*a* may have a first sizing comparable to the fluid vents 108 and a plurality of slots 130*b* may have a second sizing comparable to the debris vents 116. Slots 130 may be positioned in an array or random pattern. Shape of each slot 130 may be similar or different to other slots 130. Additionally, slots 130 may be any shape including, but not limited to oval, circular, square, and/or any fanciful shape.

In another embodiment, the actuator assembly may be easily reconfigured to a rotary actuator system by replacing the ball or lead screw with a gear box and shaft extending through the compensation piston seal. The gearbox is not required if the motor torque alone is sufficient. In contrast, other systems are either non-compensated or include complicated magnetic couplings. The subject actuator assembly allows use of piston or interchangeable membrane compensation system while minimizing the system's overall length and retaining the other features and benefits described above.

Figure 4:
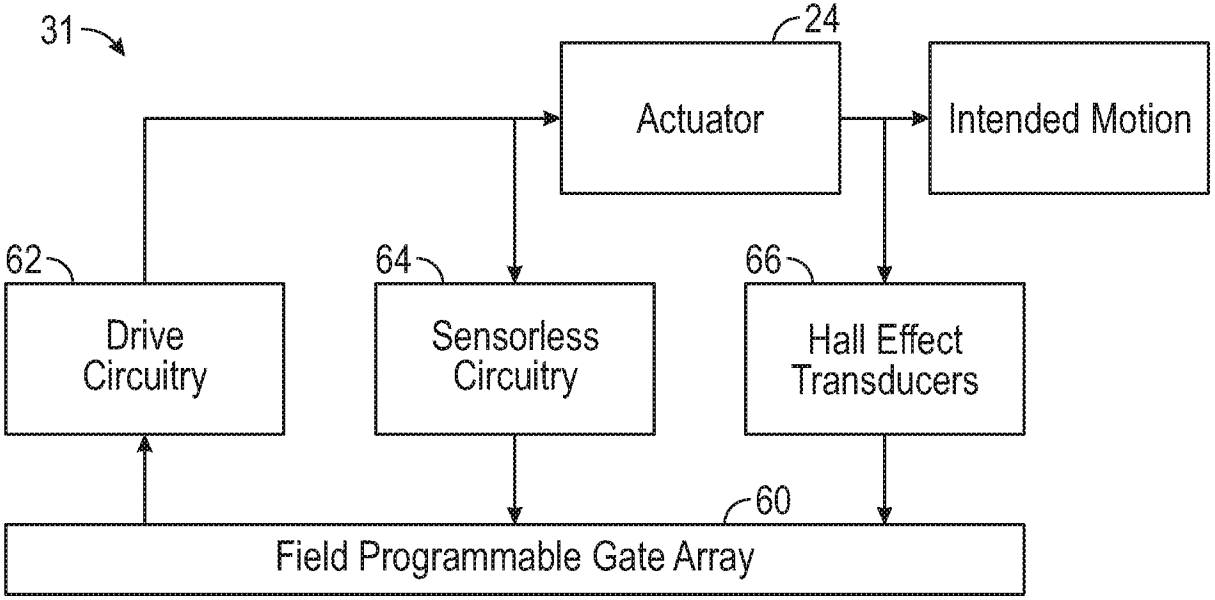
FIG. 4 illustrates a block diagram of an implementation of the set of electronic circuits of the actuator.

The actuator includes the set of electronic control assembly 31. FIG. 4 illustrates an implementation of the electronic component assembly 31 of the actuator assembly 20. The electronic components may include a state machine, implemented in a programmable device 60 that controls the motion of the actuator via position feedback generated either by a motion sensing device or back electromotive force. The programmable device 60 may be, for example, a micropower flash based Field Programmable Gate Array (FPGA), one or more suitably programmed processors (e.g., microprocessors) and associated hardware and software or hardwired logic, an application specific integrated circuit (ASIC) or a combination of hardware and software, and/or the like.

The electronics may further comprise a set of drive circuitry 62 that are controlled by the state machine and generate drive signals to drive the rotary actuator 24 (back EMF signals). Those drive signals are also input to a set of sensorless circuitry 64 which feed control signals back to the state machine that can be used to control the actuator if one or more of the motion sense devices fail as described below. The electronic components may also include one or more well known Hall Effect sensors/transducers 66 that measure the movement/action (intended motion) of the actuator and feed back the signals to the programmable device 60 so that the programmable device can adjust the drive signals for the actuator as needed. In one implementation, the hall effect sensors are contained within a purchased motor assembly. However, the actuator may also use other sensors, such as a synchroresolver, an optical encoder, magnet/reed switch combination, magnet/coil induction, proximity sensor, capacitive sensor, accelerometer, tachometer, mechanical switch, potentiometer, rate gyro, etc.

The transducer feedback signal from the sensors 66 provide the best power efficiency during all mechanical loading scenarios and thus increases battery life and reduces operating costs due to battery replacement. However, Hall effect transducers are prone to malfunction due to the abusive down hole environment. Hall effect transducers are presently considered the preferred motion control device because they are relatively reliable verses other motion sensors in an abusive environment. Thus, in the control electronics, a firmware mechanism is in place to switch over to the less power efficient back electromotive force position feedback using the sensorless circuitry 64 if any one or more of the Hall motion control devices. (Hall A sensor, Hall B sensor and Hall C sensor, for example) fail to return diagnostic counts. For example, the method may operate as follows: if Hall B fails to generate diagnostic counts, then Hall A will be utilized, back electromotive force signal B will be utilized, and Hall C will be utilized. Power efficiency will not suffer in this case and reliability will be maintained. If more than one Hall effect transducers fails, the firmware will rely altogether on the back electromotive force position feedback (back electromotive force signal A, back electromotive force signal B and back electromotive force signal C) and power efficiency will now be reduced somewhat, but proper operation will still be maintained.

Figure 5:
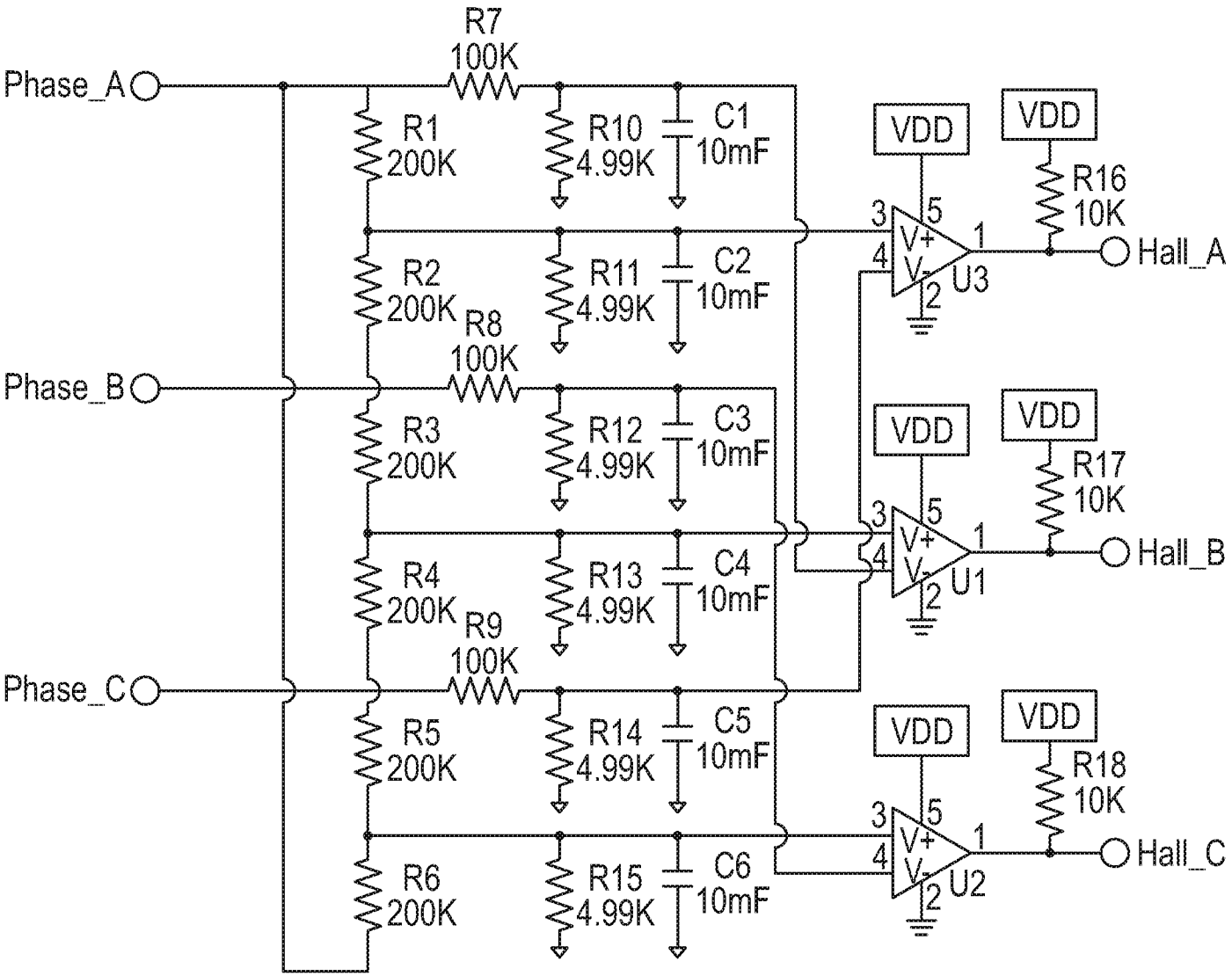
FIG. 5 illustrates an implementation of a circuit that converts back EMF signals into Hall signal equivalents.

FIG. 5 illustrates an implementation of a circuit that converts back EMF signals into Hall signal equivalents. In the implementation shown, the back EMF signals (Phase A, Phase B and Phase C) are converted using resistors, capacitors and operational amplifiers [comparators] as shown to generate the Hall A, Hall B and Hall C signals as shown if this were a multi-phase system.

The set of electronic control components 31 may also provide diagnostic/logging data functions that may be recorded using mission critical tactics. Typical methods of storing nonvolatile data are usually writing data to flash memory in large, quantized, page segments so that, if a power anomaly or reset occurs during a page write a large amount of data can be easily lost. A typical 1 kilobyte page may store hours of diagnostic or log data. In order to prevent this loss of data, a new type of nonvolatile memory, other than flash, may be utilized that allows for fast single byte writes instead of large, susceptible 1 kilobyte page writes to flash memory. In one implementation, the nonvolatile memory may be a ferroelectric random access memory (F-RAM) which is a non-volatile memory which uses a ferroelectric layer instead of the typical dielectric layer found in other non-volatile memories. The ferroelectric layer enables the F-RAM to consume less power, endure 100 trillion write cycles, operate at 500 times the write speed of conventional flash memory, and endure the abusive down hole environment. The use of the new type of nonvolatile memory minimizes data loss via a single byte transfer instead of a 1 kilobyte data transfer.

Figure 6:
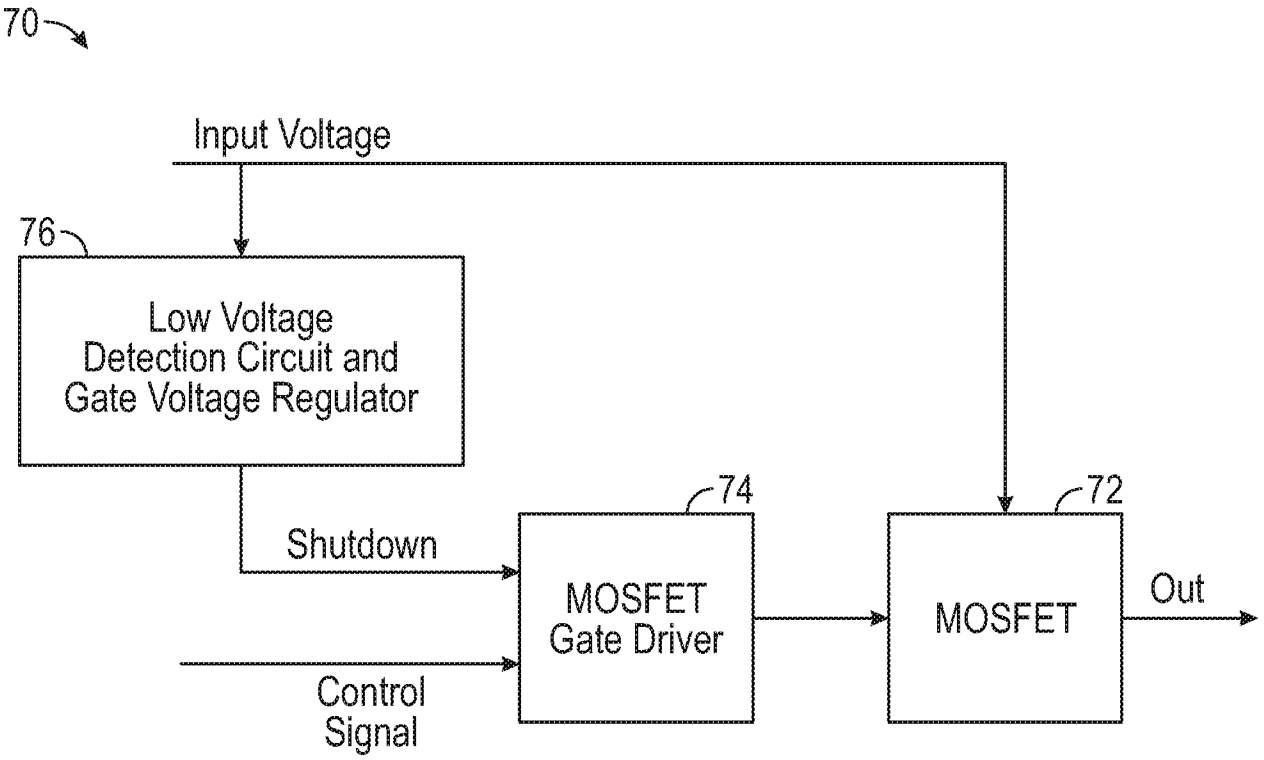
FIG. 6 illustrates an implementation of the MOSFET drive circuitry of the actuator.

The set of electronic control components 31 may also have special MOSFET gate driver circuitry 70 (See FIG. 6 that illustrates an implementation of the MOSFET drivers 70) that are utilized in order to regulate the gate drive voltage applied to one or more MOSFETs 72 over changing input voltage wherein the input voltage is typically supplied by batteries. A MOSFET is the preferred switch; however, any other switch can be utilized. In the circuitry, each MOSFET has a gate driver circuit 74 that generates the gate voltage for each MOSFET and a low voltage detection circuit and gate voltage regulator 76 that controls the gate driver circuit 74 in that it can provide a shutdown signal when the voltage is too low. The regulation of the gate voltage to an optimal voltage allows the MOSFET to dissipate minimal power over large input voltage swings so that MOSFET temperature rise is minimized which increases reliability. The set of electronic control components 31 may also have the circuit 76 that can disable the MOSFETs if the input voltage drops to a level wherein the optimal gate voltage cannot be maintained, thus eliminating MOSFET overheating and self destruction.

The downhole actuator described above also provides a simple method for filling oil or other dielectric fluids into the actuator that contributes to ease of maintenance. In existing systems, some of which use a membrane for compensation, the membrane collapse under vacuum (when the oil is removed) creating air traps and possibly damaging the membrane. Furthermore, removing excess oil from existing membrane compensation systems is also more complicated as it is more difficult to access the membrane to displace the oil from the membrane without fixtures that applies pressure to the membrane. The structure and porting required to integrate membrane compensated systems also adds fluid volume to the system which it must compensate for. In contrast, the downhole actuator described above allows vacuum oil filling of the system before installation of the compensation piston or membrane. Thus, the compensating member (piston or membrane) may be removed before the vacuum oil fill process and the compensating member is installed after the vacuum fill is complete. In addition, excess oil is displaced from the system by simply opening a port and installing the compensation piston to the required position.

The actuator described above may also be tested for leaks in a unique manner. Specifically, a force may be applied to the pressure compensating system 29 (i.e., piston). The force on the pressure compensating system 29 may pressurize the fluid in the fluid filled housing, such as for example oil, so that leaks in the fluid filled housing may be detected.

The actuator described above has the following overall characteristics that overcome the limitations of the typical systems. The actuator may reduce the number of components to achieve the same functions in a more effective manner. There may be simplified cost, maintenance, and improved reliability by reducing the number of components and configuring components for simplified access. The actuator may utilize piston compensation versus elastomeric membrane compensation which improved survivability in environments which deteriorate the elastomeric membrane.

The shock absorbing, self aligning, system may enable smaller load bearing and reciprocating components. The use of a smaller number of components may reduce cost, power requirements and/or size. The shock absorbing member(s) and hydraulic restriction scheme may provide a control feedback mechanism. The design may provide for attachment of the shaft while simplifying installation and removal with the t-slot configuration. The disc may provide shaft lateral support while not interfering with reciprocation or pressure balancing. The debris trap to the screen housing may reduce the chance of clogging of a downhole valve. Electronics features to the drive circuitry may improve reliability. Recording of diagnostic data that is critical to performance of the actuator may aid in failure analysis and other diagnosis. Circuitry may improve MOSFET reliability over all input voltage and abusive environment conditions.

From the above description, it is clear that the inventive concepts disclosed and claimed herein are well adapted to carry out the objects and to attain the advantages mentioned herein, as well as those inherent in the invention. While exemplary embodiments of the inventive concepts have been described for purposes of this disclosure, it will be understood that numerous changes may be made which will readily suggest themselves to those skilled in the art and which are accomplished within the spirit of the inventive concepts disclosed and claimed herein.

What is claimed is:

1. An electromechanical actuator, comprising:

a servo valve;

a valve housing having a wall surrounding the servo valve, the valve housing having a first end at an upstream end of the valve housing and a second end at a downstream end of the valve housing with the servo valve positioned between the first end and the second end, the valve housing comprising:

at least one debris vent extending from an exterior surface of the wall to an interior surface of the wall and positioned between the servo valve and the first end of the valve housing, the debris vent having a first dimension; and, at least one fluid vent extending from the exterior surface of the wall to the interior surface of the wall and positioned between the servo valve and the second end of the valve housing, the fluid vent having a second dimension;

wherein the first dimension is smaller than the second dimension.

2. The electromechanical actuator of claim 1, wherein the valve housing includes a first debris vent and a second debris vent with dimension of the first debris vent and the second debris vent being different.

3. The electromechanical actuator of claim 1, wherein the valve housing includes a first fluid vent and a second fluid vent with dimensions of the first fluid vent and the second fluid vent being different.

4. The electromechanical actuator of claim 1, wherein the valve housing further includes a screen assembly, the screen assembly covering at least one of the debris vent or the fluid vent.

5. The electromechanical actuator of claim 4, wherein the screen assembly circumferentially wraps about at least a portion of the exterior surface of the valve housing.

6. The electromechanical actuator of claim 5, wherein the screen assembly extends across at least a portion of the servo valve.

7. The electromechanical actuator of claim 4, wherein at least one screw attaches the screen assembly to the valve housing.

8. The electromechanical actuator of claim 1, wherein at least one fluid vent is angled at a non-normal angle relative to the exterior surface of the valve housing.

9. The electromechanical actuator of claim 8, wherein the fluid vent is angled in the wall of the valve housing towards the servo valve.

10. The electromechanical actuator of claim 9, wherein the fluid vent has an outer opening in the exterior surface of the wall and an inner opening in the interior surface of the wall and the fluid vent is angled in the wall of the valve housing such that no part of the outer opening of the fluid vent aligns with any part of the inner opening of the fluid vent which prevents direct lateral access of fluid from the outer opening of the fluid vent to the servo valve.

11. The electromechanical actuator of claim 1, wherein the first dimension of the debris vent is substantially 0.0625 inches.

12. The electromechanical actuator of claim 11, wherein the second dimension of the fluid vent is substantially 0.25 inches.

* * * * *